US011399617B2

(12) United States Patent
Dinh

(10) Patent No.: US 11,399,617 B2
(45) Date of Patent: Aug. 2, 2022

(54) DISPENSER SYSTEMS HAVING A PLURALITY OF CONTAINERS

(71) Applicant: Nga Dinh, Hillsboro, OR (US)

(72) Inventor: Nga Dinh, Hillsboro, OR (US)

( * ) Notice: Subject to any disclaimer, the term of this patent is extended or adjusted under 35 U.S.C. 154(b) by 0 days.

(21) Appl. No.: 16/954,150

(22) PCT Filed: Mar. 13, 2020

(86) PCT No.: PCT/US2020/022648
§ 371 (c)(1),
(2) Date: Jun. 15, 2020

(87) PCT Pub. No.: WO2020/186167
PCT Pub. Date: Sep. 17, 2020

(65) Prior Publication Data

US 2021/0401151 A1 Dec. 30, 2021

Related U.S. Application Data

(60) Provisional application No. 62/818,358, filed on Mar. 14, 2019.

(51) Int. Cl.

| | |
|---|---|
| ***A45D 40/24*** | (2006.01) |
| ***A45D 34/04*** | (2006.01) |
| ***A45D 40/26*** | (2006.01) |
| ***A47K 10/32*** | (2006.01) |

(52) U.S. Cl.
CPC ..... *A45D 40/24* (2013.01); *A45D 34/04* (2013.01); *A45D 40/26* (2013.01); *A45D 34/042* (2013.01); *A45D 40/262* (2013.01); *A45D 2200/051* (2013.01); *A47K 10/32* (2013.01); *A47K 2010/3266* (2013.01)

(58) Field of Classification Search
CPC ..... A45D 40/24; A45D 34/04; A45D 34/042; A45D 40/262; A45D 2200/051; A45D 200/05; A45D 200/10; A47K 10/32; A47K 2010/3266; A47K 10/42; A47K 10/426; A46B 11/00; A46B 11/001; A46B 11/0065; A46B 11/0072; A46B 11/0089
USPC ..... 401/270, 269, 44–47; 215/227
See application file for complete search history.

(56) References Cited

U.S. PATENT DOCUMENTS

| | | | | |
|---|---|---|---|---|
| 1,797,465 A * | 3/1931 | De Biasi | B43K 27/08 | 401/45 |
| 4,651,890 A * | 3/1987 | Coker | B65D 77/24 | 215/6 |
| 7,585,125 B2 * | 9/2009 | Muhlhausen | B65D 81/3205 | 401/125 |
| 7,722,277 B2 * | 5/2010 | Byun | B65D 35/36 | 401/269 |
| 8,550,739 B1 * | 10/2013 | Robbins | A46B 11/0065 | 401/133 |
| 11,259,616 B2 * | 3/2022 | Bickford | A45D 34/04 | |

* cited by examiner

*Primary Examiner* — David J Walczak

(57) ABSTRACT

Dispenser systems including a plurality of containers and an applicator. The plurality of containers are supported together to define a container set. Each container in the plurality of containers includes a dispenser configured to dispense contents within the container. The applicator is operatively coupled to the container set and configured to apply contents from the containers to a target surface. In some examples, the dispenser system includes a cap. In certain examples, the dispenser system includes a cleaning system.

19 Claims, 16 Drawing Sheets

DISPENSER SYSTEMS HAVING A PLURALITY OF CONTAINERS

CROSS REFERENCE TO RELATED APPLICATIONS

This application claims priority to U.S. application Ser. No. 62/818,358, filed on Mar. 14, 2019, and to copending Patent Cooperation Treaty Application No. PCT/US20/22648, filed on Mar. 13, 2020, which are hereby incorporated by reference for all purposes.

BACKGROUND

The present disclosure relates generally to dispenser systems. In particular, dispenser systems having a plurality of containers are described.

Many individuals consider caring for one's skin to be important for health, aesthetic, and hygienic reasons. Topically applying skincare products, often to one's face, arms, hands, legs and feet, is a common method of caring for one's skin. Some practice skincare regimens that involve multiple steps, including a popular ten step skincare regimen.

A wide variety of skincare products exist, commonly in the form of creams, lotions, salves, toners, serums, treatments, and moisturizers. Different skincare products may serve different purposes. Often personal skincare regimens include topically applying multiple different skincare products.

Many skincare products benefit from being topically applied with an applicator. Applying product by hand is time consuming and unhygienic because one must open and close multiple containers and touching one's face after touching the container surfaces can transfer germs to one's mouth, eyes, nose, and ears. Further, applying skincare products by hand can leave one's hands greasy and slippery.

Conventional means for storing, dispensing, and applying skincare products have various disadvantages. For example, storing and using multiple containers of skincare product is cumbersome, inconvenient, messy, and unorganized. Working with individuals product containers increases the chances of misplacing a given container, cap, or applicator.

Existing attempts to manage multiple containers of skincare products are not entirely satisfactory. For instance, known systems for managing multiple containers of skincare products either lack an applicator component or are limited to housings with fixed chambers of predetermined size in which to contain different skincare products. Housings with fixed containers generally limit people to a single brand of skincare products rather than allowing them to mix and match skincare products from different brands.

Further, housings with fixed chambers of predetermined size do not accommodate changes in the number or size of the containers within the dispenser systems nor do they allow a user to swap out containers as he or she sees fit. For example, a user may later wish to have a larger size container in the dispenser systems to store a skincare product in larger volume.

Some known attempts to manage multiple skincare products in a single system or housing are undesirably complex. For example, some existing solutions require microprocessors, sensors, and other electronics to function. Complex electronics increase costs and are more prone to malfunction than mechanical solutions.

Even known mechanical solutions suffer from complexities. For instance, some existing mechanical dispenser systems rely on a centralized pumping element and/or a centralized outlet. Centralized pumping elements limit a system to predefined container configurations and sizes. When the container configuration and/or sizes are changed, the system must undergo complex redesign efforts. A centralized outlet also limits the forms of products that can be stored within the dispenser systems. When different forms of products must exit through one single outlet, some products, such as cream or oil, can leave behind residues that cause clogging issues over time or unintended product mixing effects.

Another limitation of conventional dispenser systems is their lack of means to clean product applicators and containers. Germs and bacteria can accumulate on product applicators and containers over time and during use. Accumulated germs and bacteria can create an unhygienic environment not ideal for close contact with one's skin, hands, face, and orifices. Lacking effective means to clean applicators and containers, current dispenser systems subject users to unhygienic conditions and increase the risk of illness or infection.

Thus, there exists a need for dispenser systems having a plurality of containers that improve upon and advance the design of known skincare product dispenser systems. Examples of new and useful dispenser systems relevant to the needs existing in the field are discussed below.

Disclosure addressing one or more of the identified existing needs is provided in the detailed description below. Examples of references relevant to dispenser systems include U.S. Patent References: U.S. Pat. No. 5,921,440 and patent application publications 20160058156 and 20160270511. The complete disclosures of the above patents and patent applications are herein incorporated by reference for all purposes.

SUMMARY

The present disclosure is directed to dispenser systems including a plurality of containers and an applicator. The plurality of containers are supported together to define a container set. Each container in the plurality of containers includes a dispenser configured to dispense contents within the container. The applicator is operatively coupled to the container set and configured to apply contents from the containers to a target surface. In some examples, the dispenser system includes a cap. In certain examples, the dispenser system includes a cleaning system.

DETAILED DESCRIPTION

Figure 1:
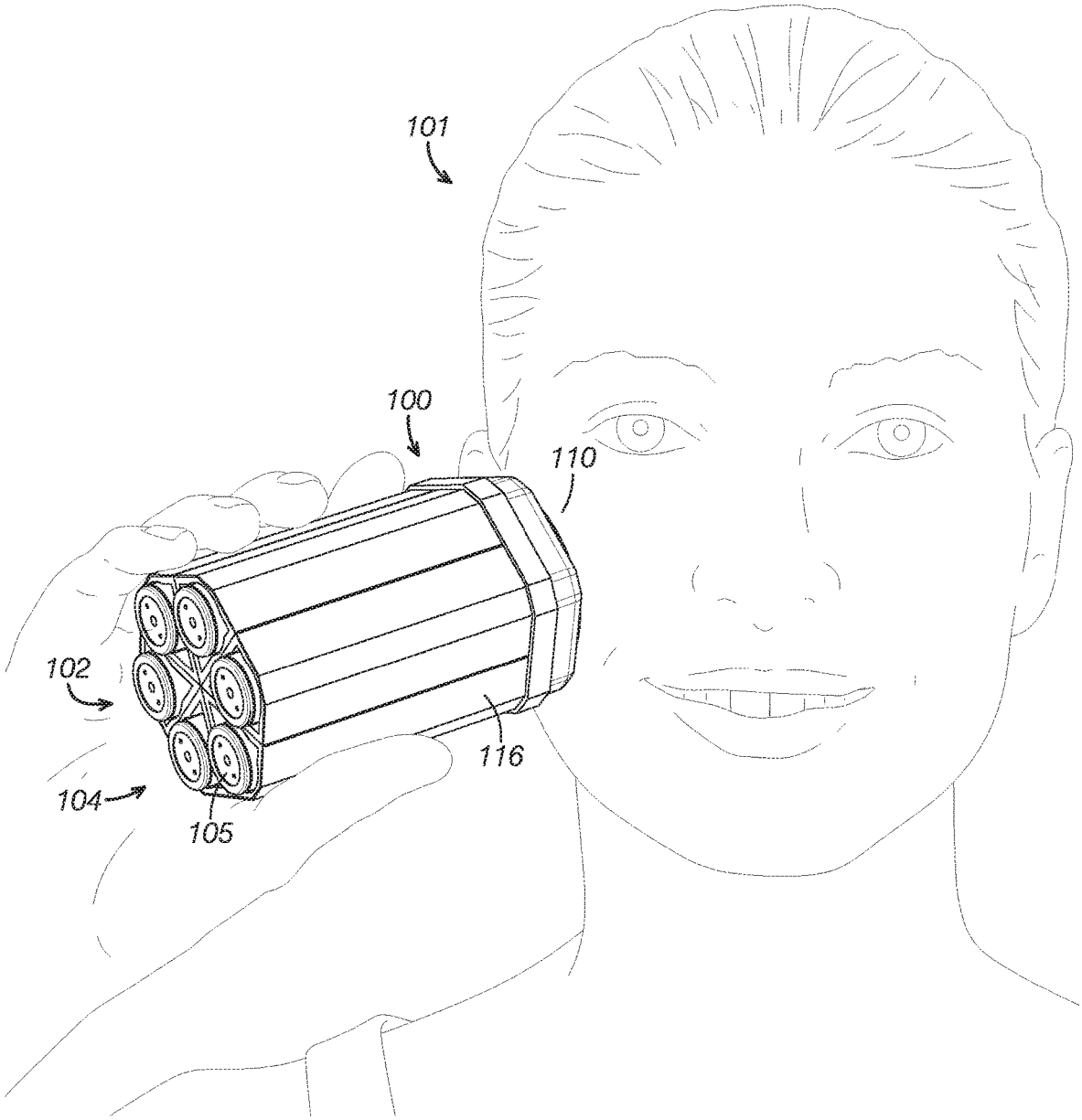
FIG. 1 is a perspective view of a person applying skin care product on her face with a first example of a dispenser system by holding the dispenser system in her hand with a cap covering an applicator removed and with the applicator pressed against her face.

The disclosed dispenser systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various dispenser systems are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Dispenser Systems Having a Plurality of Containers

With reference to the figures, dispenser systems having a plurality of containers will now be described. The dispenser systems discussed herein function to dispense skincare products from a plurality of containers. In particular, the dispenser systems are configured to accommodate different forms of skincare products produced by different manufacturers and to accommodate different size containers. Additionally or alternatively, the dispenser systems can be used to dispense other products in the form of pastes, slurries, ointments, and the like, such as medicines, makeup, and sunscreen.

The presently described dispenser systems address many of the shortcomings existing with conventional dispenser systems. For example, the dispenser systems described here support skincare product produced by different manufacturers instead of being limited to product produced by just one skincare product manufacturer. Further, the novel dispenser systems below accommodate a variety of different size containers and allow a user to swap out containers as he or she sees fit.

Another improvement over conventional dispenser systems is the lack of complexity existing in the presently described dispenser systems. For example, the dispenser systems described below do not rely on complicated and expensive electronics, which improves reliability and reduces cost. Further, the dispenser systems described here do not require a central pumping mechanism or central outlet, but instead utilize actuators or outlets built into the containers by the container manufacturers. Thus, the presently described dispenser systems are more adaptable to different container configurations and are less complicated to engineer.

The dispenser systems described below improve over known dispenser systems by including cleaning features in certain examples to make the dispenser system more hygienic for the user. By including cleaning features, the present dispenser systems help reduce illness and infection and make using the dispenser system a more pleasant experience.

Dispenser System Embodiment One

With reference to FIGS. 1-9 and 16, a first example of a dispenser system, dispenser system 100, will now be described. Dispenser system 100 functions to dispense and apply content 103 stored in dispenser system 100 to a target surface 110. In the example shown in FIGS. 1-9 and 16, dispenser system dispenses and applies skincare products to the skin of a person 101.

Dispenser system 100 includes a plurality of containers 102, an applicator 108, a housing 116, a cap 122, and a cleaning system 130. In some examples, the dispenser system includes fewer, additional, or alternative features.

For example, some dispenser system examples do not include a housing, a cap and/or a cleaning system.

In certain dispenser system examples, a microprocessor, associated circuitry, and a display and/or audio device is provided along with instructions encoded in memory for communicating information to the user of the dispenser system based on the parameters detected by the one or more sensors. For example, the microprocessor may communicate to the user via the display and/or audio device an optimal order in which to use the products based on the detected pH levels and/or viscosity of the product. The encoded instructions for the order of product application may be based on observed effectiveness correlations indicating that applying skincare products in order of increasing pH levels and viscosity is an especially effective technique. In another example, the encoded instructions may cause the microprocessor to communicate a warning message to the user if a harmful or incompatible ingredient is detected.

Plurality of Containers

Plurality of containers 102 function to store and dispense content 103 within each container 105. In the present example, the content stored and dispensed by plurality of containers 102 are skincare products, but the containers may contain any currently known or later developed content. Suitable content includes solids, liquids, and gases in various forms and combinations, such as lotions, creams, gels, granules, slurries, and vapors. In examples where the contents are skincare products, the skincare products may be any currently known or later developed type of skincare product.

Plurality of containers 102 are supported together to define a container set 104. Container set 104 functions as an integrated unit allowing user 101 to conveniently hold, move, and manipulate all of containers 105 included in container set 104 at once.

In the present example, plurality of containers 102 are supported together by housing 116. In some examples, with or without a housing, the containers are held together by magnetic attraction provided by a magnetic coating applied to the containers. In some examples where magnetic attraction is utilized, magnets are secured to the containers via adhesives or fasteners. In some examples, the walls of the containers are integrally magnetic. In some examples, a portion of the container is magnetic and another portion is subject to magnetic attraction, such as metals and metal coatings.

Additionally or alternatively to magnetic attraction, in some examples the containers are held together mechanically with fasteners or interlocking features designed into the containers. In some examples, the containers are held together with adhesives or hook-and-loop fasteners. In additional examples, the containers are bound together or supported within a tray, by a holding rack, or, as in FIGS. 1-9 and 16, by a housing.

Container

Containers 105 serve to store and selectively dispense skincare product. The containers contain different skincare products from different manufacturers. In some examples, the containers are designed to form a substantially airtight seal to provide an "airless" container as that term is known in the product container industry. Airless container help maintain the integrity of product contained within a container by reducing oxidation reactions that can occur when a product is exposed to oxygen molecules in the air.

With reference to FIGS. 5, 7, 9, and 16 each container 105 in plurality of containers 102 includes a dispenser 106 and an actuator 111. Dispenser 106 is configured to dispense content 103 within container 105. As shown in FIGS. 2, 5, 7, 9, and 16, dispenser 106 defines an outlet 107 through which content 103 exits container 105.

The outlet may be any currently known or later developed form of product outlet, including ports, nozzles, and the like. In some examples, as shown in FIG. 12, the outlet is disposed on the side of the container whereas in other examples, such as shown in FIGS. 1-9 and FIG. 13, the outlet is disposed at the top of the container.

Figure 12:
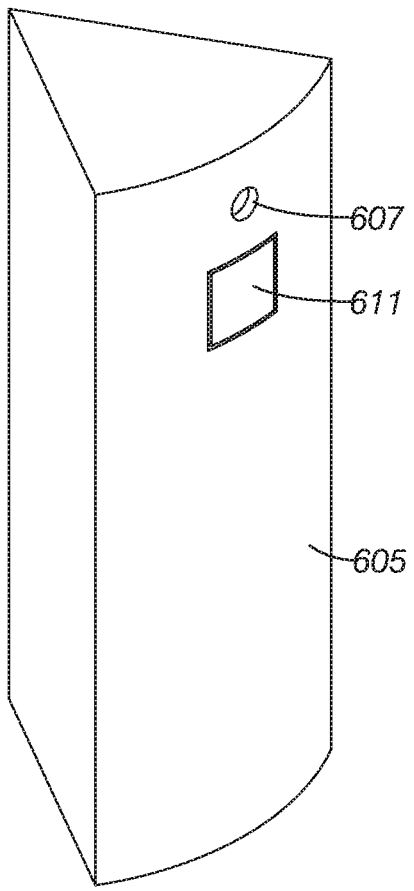
FIG. 12 is a perspective view of a second example of a container, the container defining a side outlet.
Figure 13:
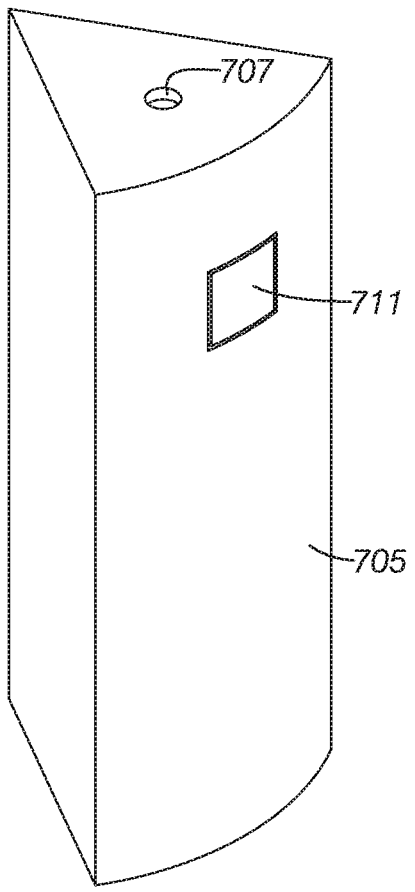
FIG. 13 is a perspective view of a third example of a container, the container defining a top outlet.

With brief reference to FIGS. 12 and 13, the reader can see suitable container examples depicted: container 605 in FIG. 12 and container 705 in FIG. 13. The containers depicted in FIGS. 12 and 13 are wedge shaped. Container 605 in FIG. 12 includes an outlet 607 on the side of container 605 and an actuator 611 on the side of container 605. Container 705 in FIG. 13 includes an outlet 707 on the top of container 705 and an actuator 711 on the side of container 705.

Actuator 111 functions to pump content 103 in container 105 out of outlet 107. In some examples, the actuator functions to open a valve in fluid communication with the outlet to allow product pressurized within the container to exit through the outlet. In the examples shown in FIGS. 1-9 and 16, actuators 111 are disposed on the top of container 105. In some examples, the actuators are disposed on the side of the containers or the bottom of the container.

Containers 105 are specifically designed for use with dispenser systems described herein. In certain examples, one or more of the containers in the plurality of containers are consumer products filled with content by a manufacturer while other containers are filled with consumer product content from a consumer product container by a user.

Figure 8:
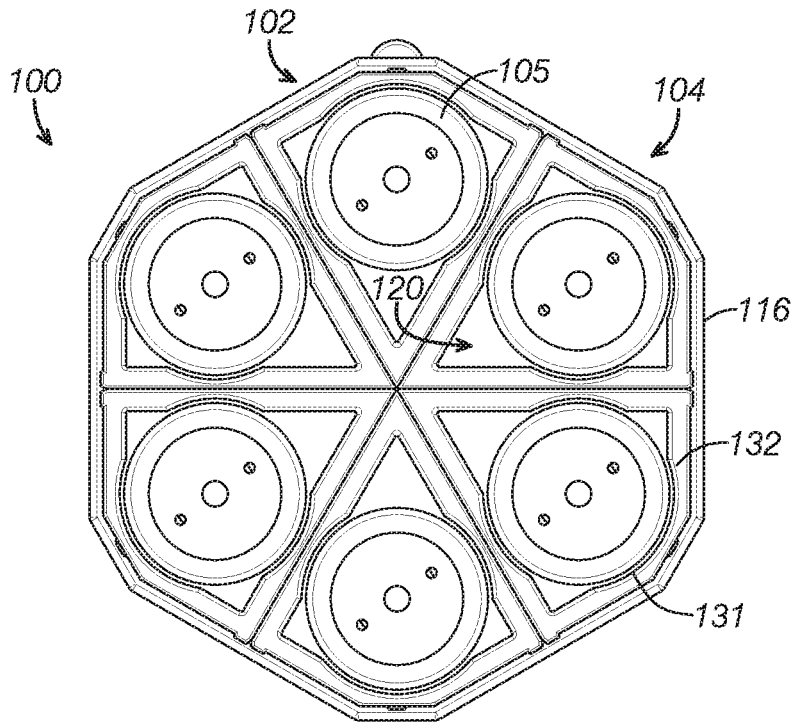
FIG. 8 is a bottom view of the dispenser system shown in FIG. 1.
Figure 9:
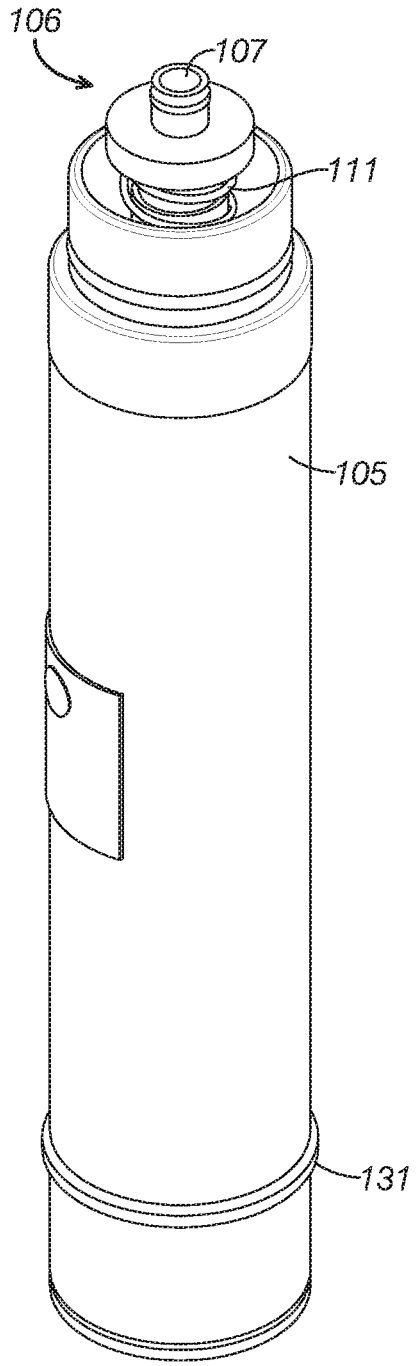
FIG. 9 is a perspective view of a container housed in the dispenser system shown in FIG. 1.
Figure 16:
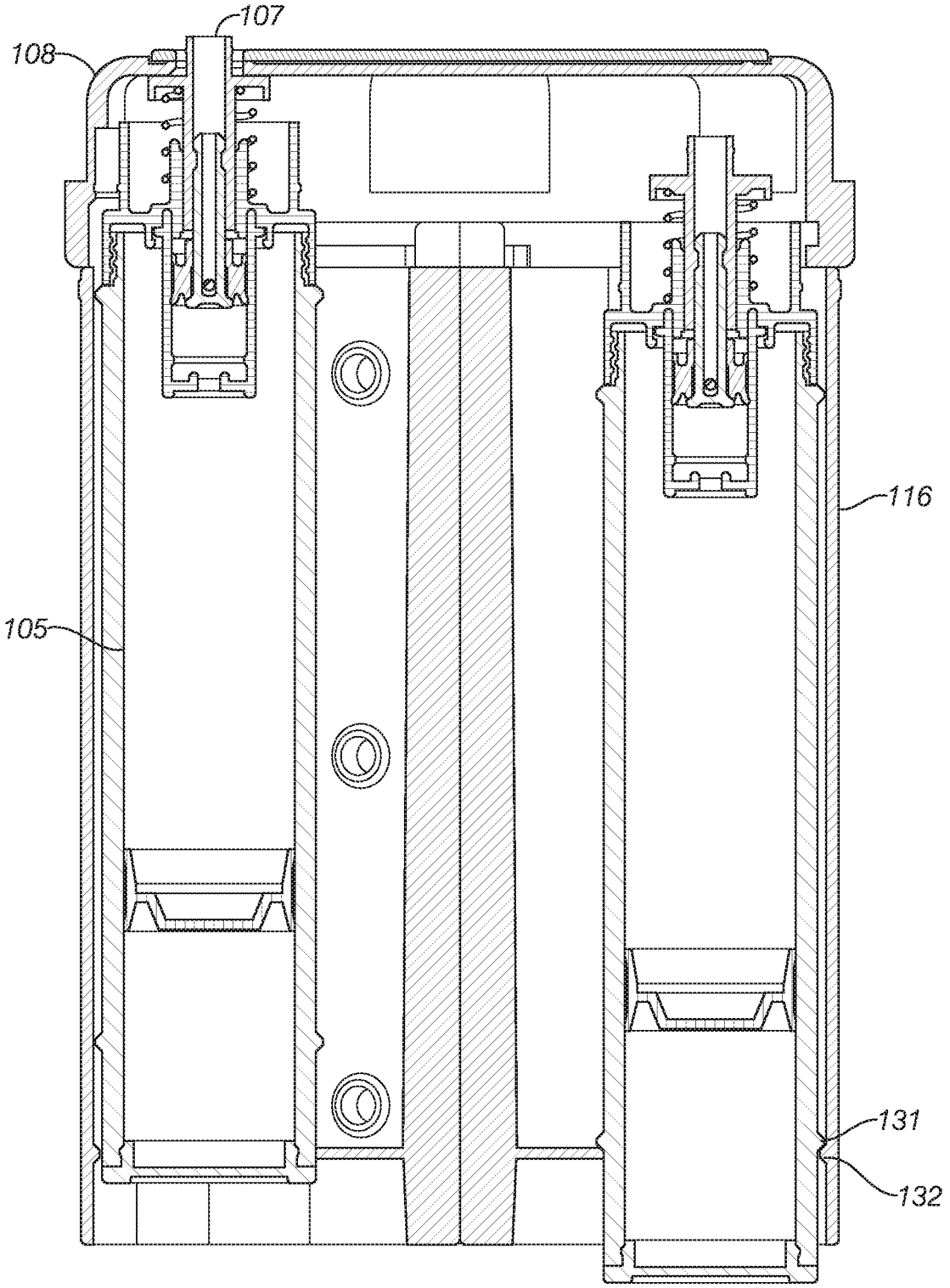
FIG. 16 is a section view of the dispenser system shown in FIG. 1 depicting a container on the left in a raised, dispensing position and a container on the right in a lowered, resting position.

As shown in FIGS. 8, 9, and 16, the containers are complementary configured with other components within the dispenser systems and play an integral part in the function of the dispenser systems. For example, in FIGS. 8, 9, and 16 the reader can see that container 105 is designed with outer ring 131 to operatively interact with inner ring 132 of housing 116. This complimentary configuration allows user 101 to move a selected container 105 up and press dispenser 106 against the inner wall of applicator 108 as an action to pump content 103 out of dispenser system 100. Additionally, this complimentary configuration allows plurality of containers 102 to remain secured within dispenser system 100 at all time. The height of container 105 is also complementary configured to the height of housing 116 and applicator 108 so that outlet 107 of container 105 is restricted from touching the wall of applicator 108 when dispenser system 100 is in rest mode or standing up on a surface. This complementary configuration reduces or prevents any accidental discharging of content 103 from dispenser system 100 when no action is taken by user 101.

The containers may be any currently known or later developed form of container suitable for containing skincare products and other similar products. In some examples, the container includes one or more sensors to detect parameters of relevance to a skincare regimen. Parameters of interest may include the pH level, viscosity, weight, or temperature of the product in the container and/or ingredients or components of the product in the container.

Applicator

Applicator 108 functions to apply content 103 from containers 105 to a target surface 110. As shown in FIG. 1, target surface 110 is a user's skin. Applying content 103 from containers 105 to the skin of user 101 with applicator 108 is more hygienic and less messy than user 101 applying content 103 with her fingers.

Figure 2:
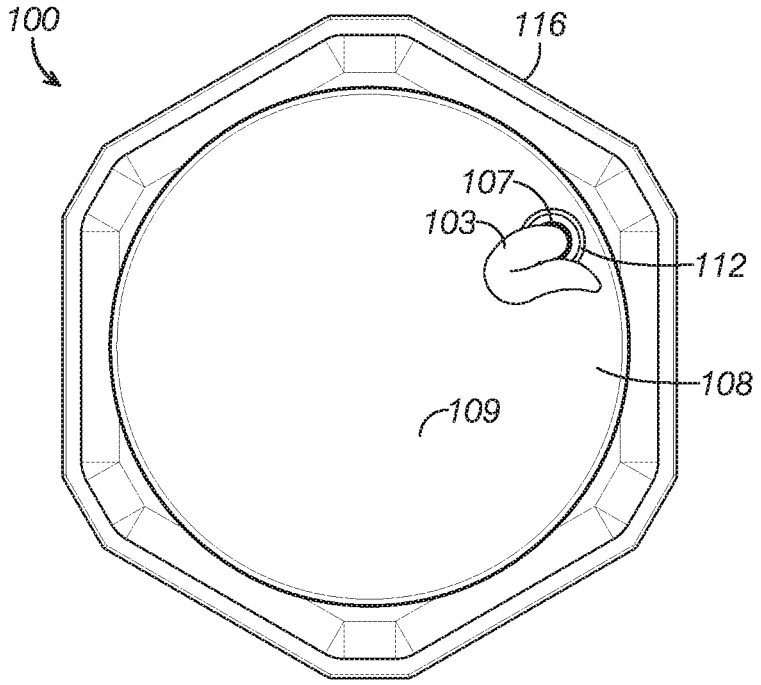
FIG. 2 is a top view of the dispenser system shown in FIG. 1 with the cap removed and skincare product from a container dispensed onto the surface of the applicator.
Figure 4:
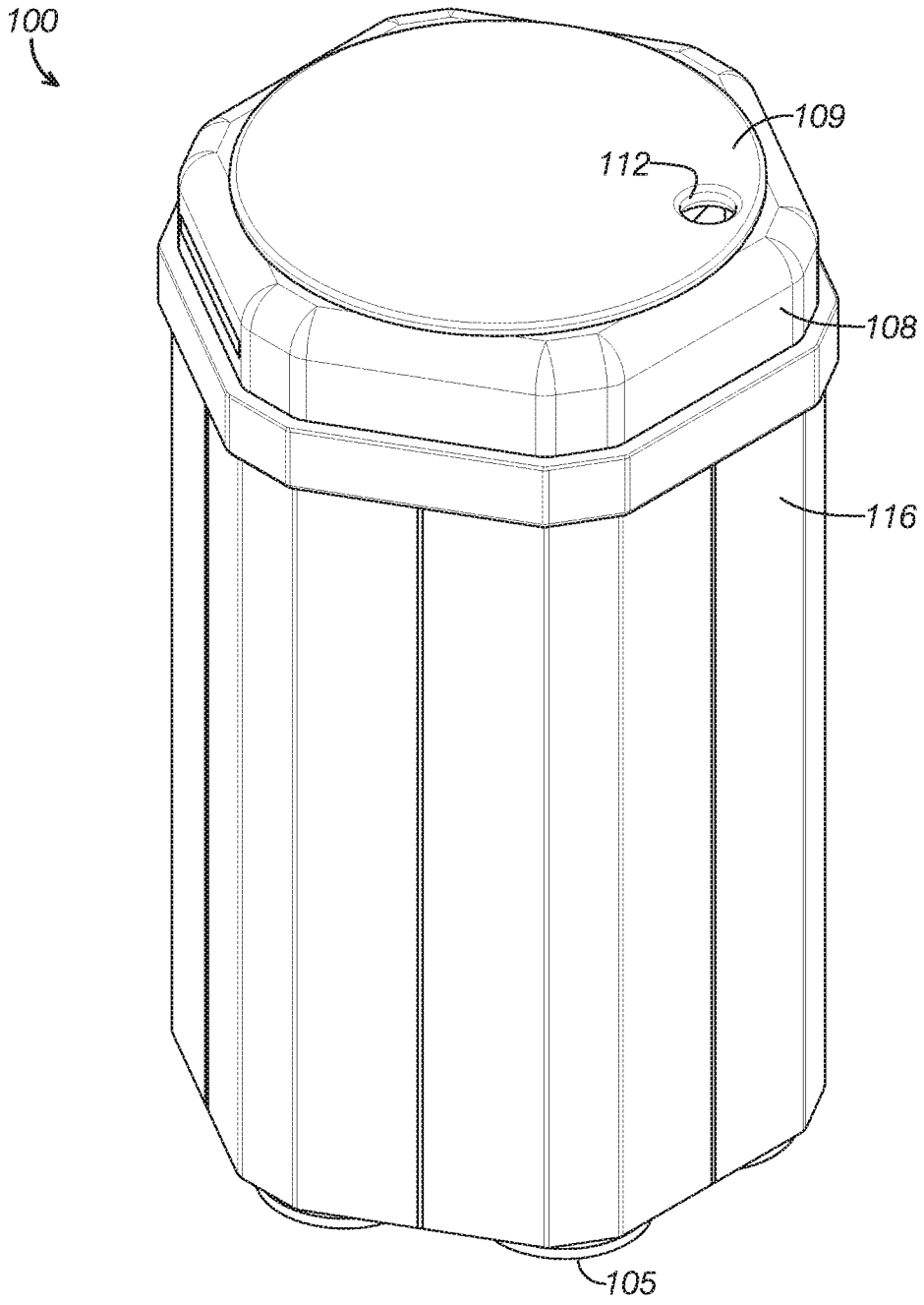
FIG. 4 is a perspective view of the dispenser system shown in FIG. 1 depicting the cap removed.

The reader can see in FIGS. 1, 2, and 4 that applicator 108 is operatively coupled to container set 104. In some examples, the applicator is removeably mounted to the container set or to the housing to enable the user to use the applicator to apply content from the containers without manipulating the container set at the same time.

In the example, shown in FIGS. 1-9 and 16, applicator 108 is movable relative to container set 104. In particular, applicator 108 is movably coupled to housing 116 in which container set 104 is disposed and supported. In the example shown in FIGS. 1-9 and 16, applicator 108 rotates relative to housing 116.

With reference to FIGS. 2, 4, and 16 the reader can see that applicator 108 has an application surface 109 and defines a port 112 extending through application surface 109. Port 112 is disposed in a position selected to align with dispenser 106 of a selected container in container set 104. As shown in FIGS. 2, 4, 5, and 16 applicator 108 and container set 104 are complementarily configured. The complementary configuration enables port 112 to align with dispenser 106 of a given container in container set 104 by moving applicator 108 to a position where port 112 aligns with dispenser 106 of the given container. The complementary configuration also enables outlet 107 to completely come through port 112 and rise beyond application surface 109 when dispenser 106 is activated to release content 103 from container 105. This configuration reduces or prevents residue of content 103 from being trapped between plurality of containers 102, applicator 108 and port 112 which would otherwise cause clogging issues within dispenser systems over time In use, user 101 may first move applicator 108 to a first position where port 112 aligns with dispenser 106 of a first container and dispense content 103 from the first container onto application surface 109 of applicator 108 through port 112. Then, user 101 may apply content 103 to target surface 110 with applicator 108 by pressing application surface 109 on which content 103 is disposed against target surface 110 as shown in FIG. 1. Subsequently, user 101 may move applicator 108 to a second position where port 112 aligns with dispenser 106 of a second container and dispense content 103 from the second container onto applicator 108 through port 112. Optionally, user 101 may clean applicator 108 with cleaning system 130 to remove any remaining content from the first container on application surface 109 before dispensing content from the second container onto applicator 108.

Housing

As shown in FIGS. 1-8, housing 116 functions to contain container set 104 and to provide a structure for user 101 to grip when manipulating dispenser system 100. Housing 116 also functions to moveably support applicator 108. In some examples, the housing fixedly supports the applicator instead of moveably supporting it.

Figure 5:
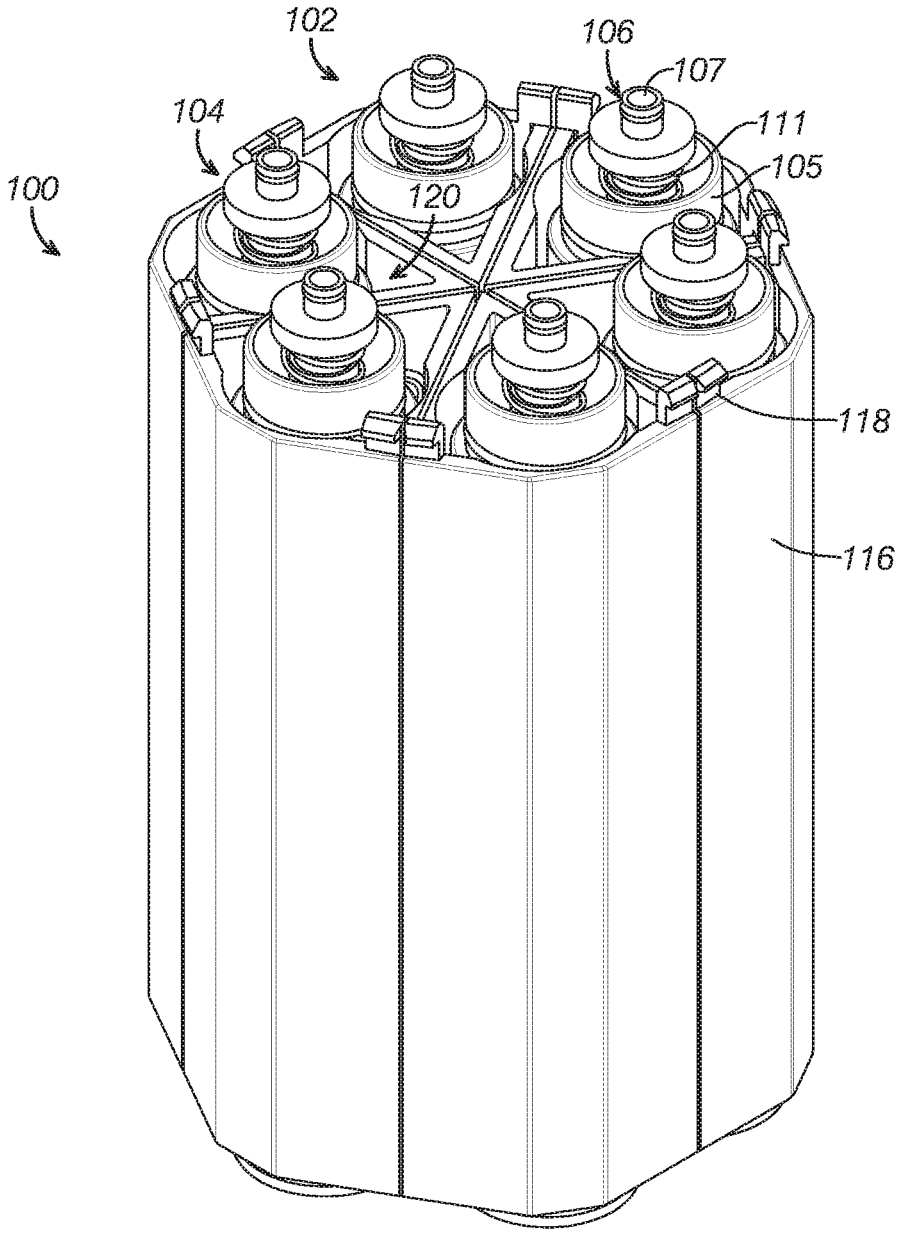
FIG. 5 is a perspective view of the dispenser system shown in FIG. 1 depicting the cap and the applicator removed.

With reference to FIG. 5, the reader can see that housing 116 defines an outer lip 118. As shown in FIG. 4, applicator 108 is moveably coupled to outer lip 118 of housing 116. In the example shown in FIGS. 1-8, applicator 108 translates along outer lip 118 to rotate relative to housing 116.

Figure 7:
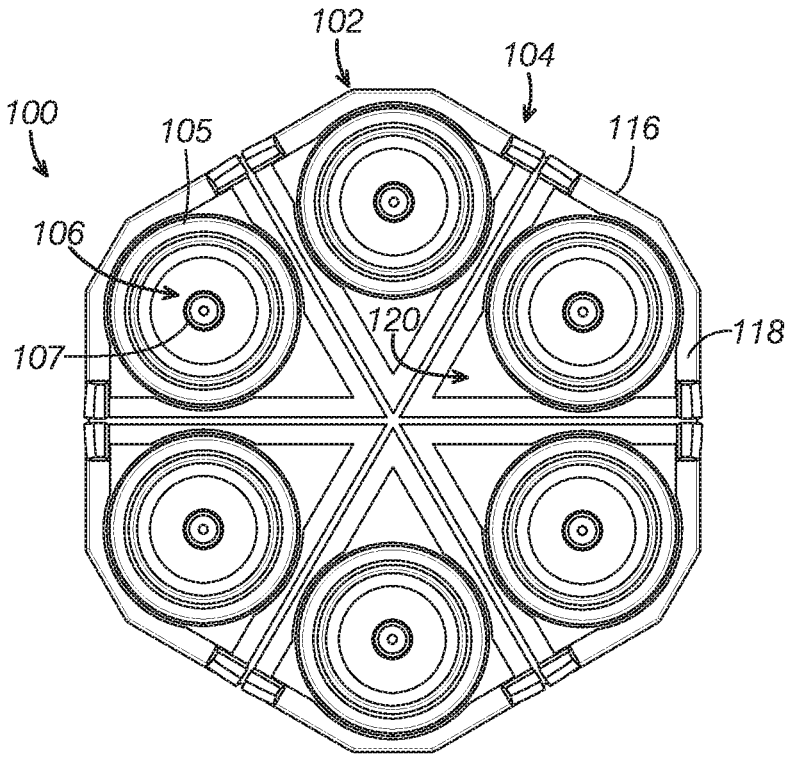
FIG. 7 is a top view of the dispenser system shown in FIG. 1 with the cap and applicator removed to depict containers in a housing.

As can be seen in FIGS. 5, 7, and 8, housing 116 defines a plurality of chambers 120. Plurality of chambers 120 are complementarily configured with plurality of containers 102. The complementary configuration enables housing 116 to receive and support plurality of containers 102 in plurality of chambers 120. The reader can see in FIGS. 5, 7, and 8 that plurality of chambers 120 are radially adjacent within housing 116. In other examples, the plurality of chambers are arranged in configurations other than radial, such as linear configurations, rectilinear configurations, and irregular configurations.

The housing may be formed from any currently known or later developed material suitable for supporting the container set and/or other components of the dispenser system. Suitable materials include plastic, polymers, metal, wood, and composites.

In the example shown in FIGS. 1-8, housing 116 is tubular and has a lateral cross section in the shape of a hexagon. In other examples, the housing has cross sections in other shapes, such as circular, square, rectangular, triangular, other regular polygons, and irregular.

Cad

Cap 122 functions to cover and protect applicator 108. In the example shown in FIGS. 1-8, cap 122 also functions to contain cleaning system 130.

Figure 3:
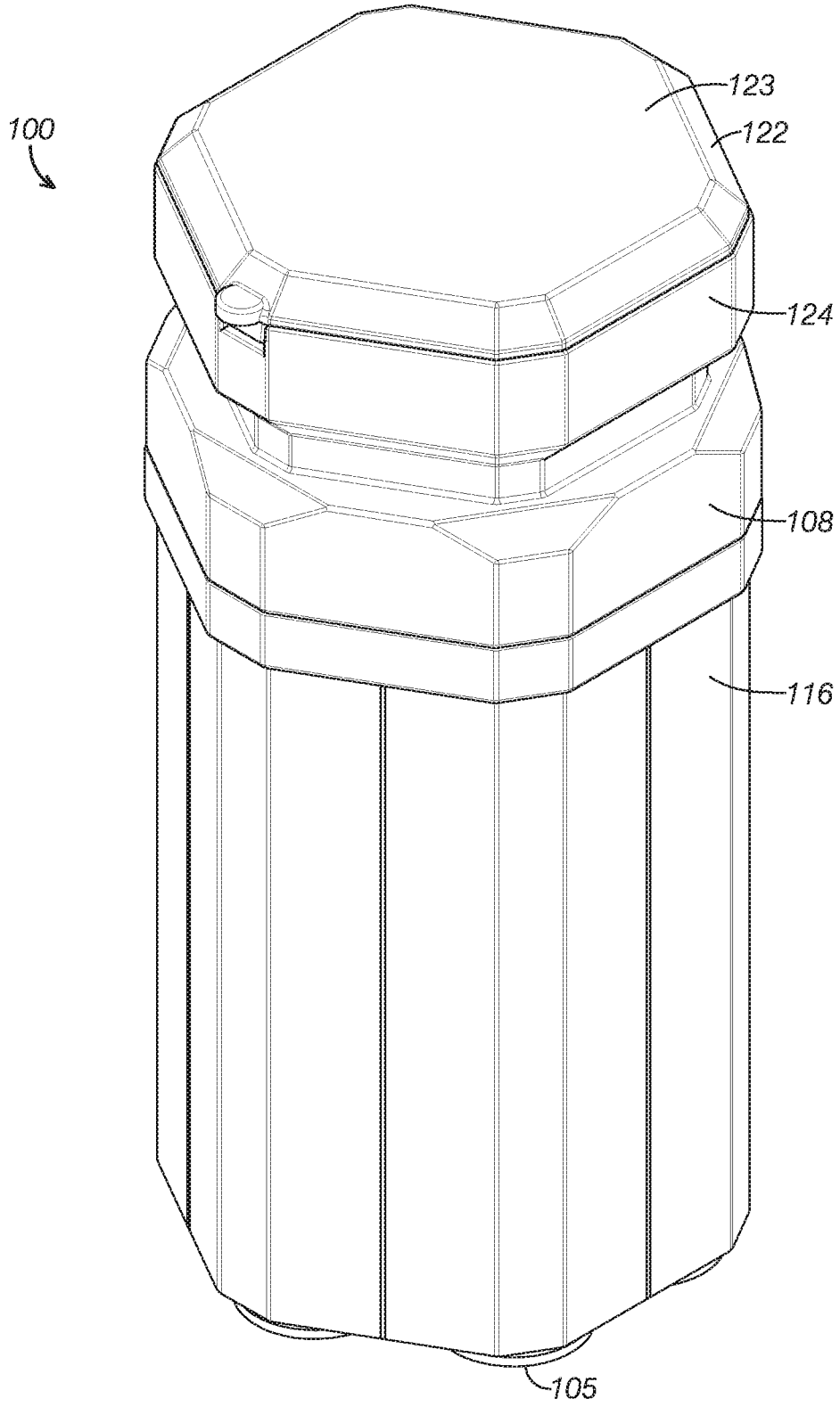
FIG. 3 is a perspective view of the dispenser system shown in FIG. 1 depicting a cap covering the applicator.

With reference to FIGS. 2 and 3, the reader can see that cap 122 overlies applicator 108. Like housing 116, cap 122 has a lateral cross section substantially in the shape of a hexagon. Other cross section shapes are contemplated, such as circular, square, rectangular, triangular, other regular polygons, and irregular.

Figure 6A:
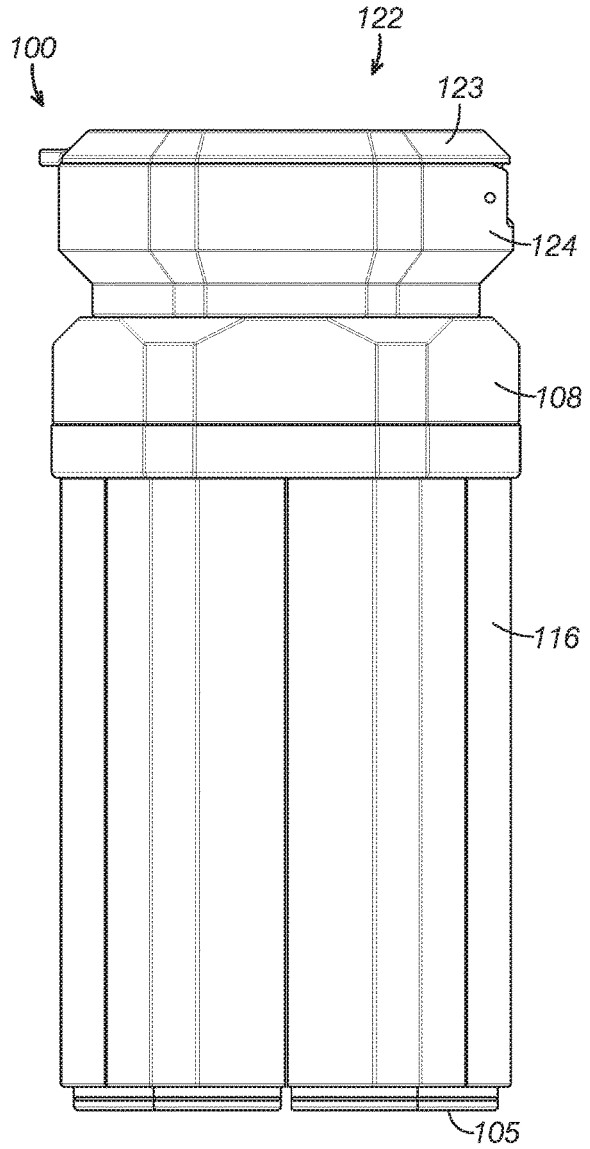
FIG. 6A is a side elevation view of the dispenser system shown in FIG. 1 with the cap covering the applicator and a cap lid pivoted closed.
Figure 6B:
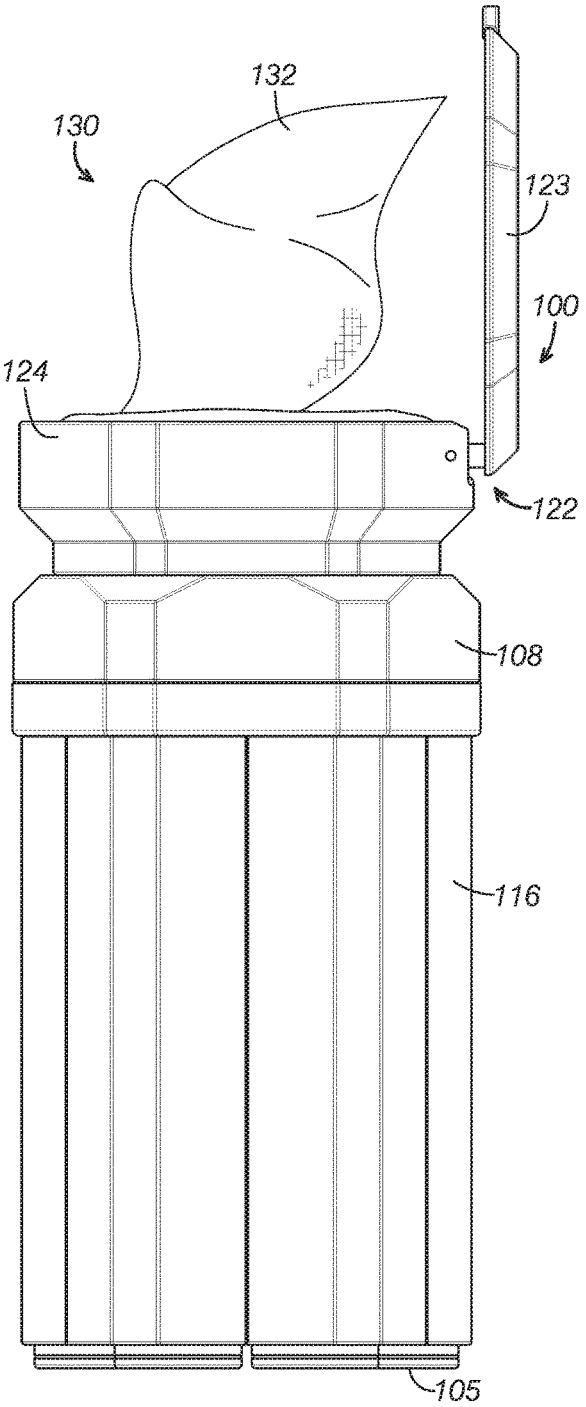
FIG. 6B is a side elevation view of the dispenser system shown in FIG. 1 with the cap covering the applicator and the cap lid pivoted open.

As shown in FIGS. 6A and 6B, cap 122 includes a body 124 and a lid 123 pivotally mounted to body 124. Pivoting lid 123 open provides access to an interior void containing cleaning system 130. In some examples, the cap is a unitary structure without a pivoting lid.

The cap may be formed from any currently known or later developed material suitable for supporting the container set and/or other components of the dispenser system. Suitable materials include plastic, polymers, metal, wood, and composites.

Cleaning System

Cleaning system 130 functions to help user 101 remove content 103, germs, bacteria, and other debris from application surface 109 in addition to cleaning other surfaces, such as the outer surface of housing 116 or target surface 110. Additionally or alternatively, user 101 may use cleaning system 130 to assist with cleaning her fingers or containers 105.

With reference to FIGS. 6A and 6B, the reader can see that cleaning system 130 is contained within cap 122. In the present example, cleaning system 130 includes cleaning media 132 in the form of wet wipes. In other examples, the cleaning media is a pad, swab, cloth, tissue, sponge, brush, or other material.

Additionally or alternatively, cleaning system may include a cleaning solution to assist with cleaning surfaces. The cleaning solution may be any currently known or later develop cleaning solution formulation. In some examples, the cleaning solution is an alcohol-based solution.

In some examples, the cleaning system includes an ultraviolet light projector to irradiate surfaces with ultraviolet light to reduce or eliminate germs and bacteria on the surfaces. In some examples, the ultraviolet light projector is mounted to irradiate the containers and the applicator to reduce or eliminate germs and bacteria on them.

Additional Embodiments

With reference to the figures not yet discussed, the discussion will now focus on additional dispenser system embodiments. The additional embodiments include many similar or identical features to dispenser system 100. Thus, for the sake of brevity, each feature of the additional embodiments below will not be redundantly explained. Rather, key distinctions between the additional embodiments and dispenser system 100 will be described in detail and the reader should reference the discussion above for features substantially similar between the different dispenser system examples.

Second Embodiment

Figure 10:
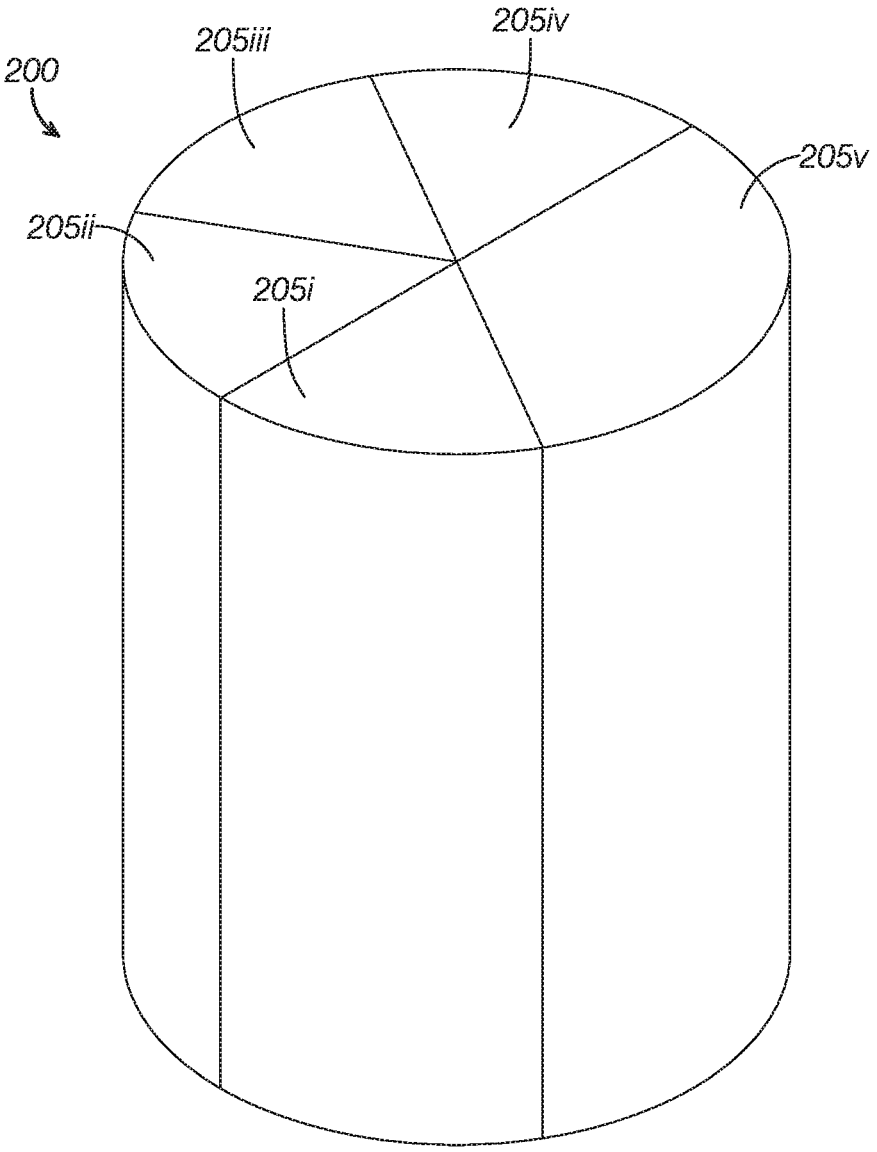
FIG. 10 is a perspective view of a second example of a dispenser system. the dispenser system including five containers.

Turning attention to FIG. 10, a second example of a dispenser system, dispenser system 200, will now be described. Dispenser system 200 include containers 205*i-v*.

A distinction between dispenser system 200 and dispenser system 100 is that dispenser system 200 does not include a housing. Instead, containers 205*i-v* are held together by magnetic attraction. In the FIG. 10 example, containers 205*i-v* are held together by magnetic attraction provided by a magnetic coating applied to the containers.

In some examples where magnetic attraction is utilized, magnets are secured to the containers via adhesives or fasteners. In some examples, the walls of the containers are integrally magnetic. In some examples, a portion of the container is magnetic and another portion is subject to magnetic attraction, such as metals and metal coatings.

Additionally or alternatively to magnetic attraction, in some examples the containers are held together mechanically with fasteners or interlocking features designed into the containers. In some examples, the containers are held together with adhesives or hook-and-loop fasteners. In additional examples, the containers are bound together or supported within a close fitting tray, by a holding rack, or by a housing.

As can be seen in FIG. 10, dispenser system 200 includes five containers 205*i-v*. Four of the containers, containers 205*i-iv*, are a first size and one container, container 205*v* is a second size approximately twice the size of containers 205*i-iv*. Thus, the reader can see in FIG. 10 that dispenser system 200 accommodates containers of different sizes. A wide variety of container number and size combinations are envisioned, for example, two extra large containers, one extra large container and three standard size containers, or three large containers. In some examples, the containers may be 15 milliliters, 30 milliliters, or 60 milliliters in volume.

Containers 205*i-v* shown in FIG. 10 are wedge shaped, but other shapes are used in other examples. For example, the containers may be rectangular, cylindrical, another type of regular polygon, or an irregular shape.

Third Embodiment

Figure 11:
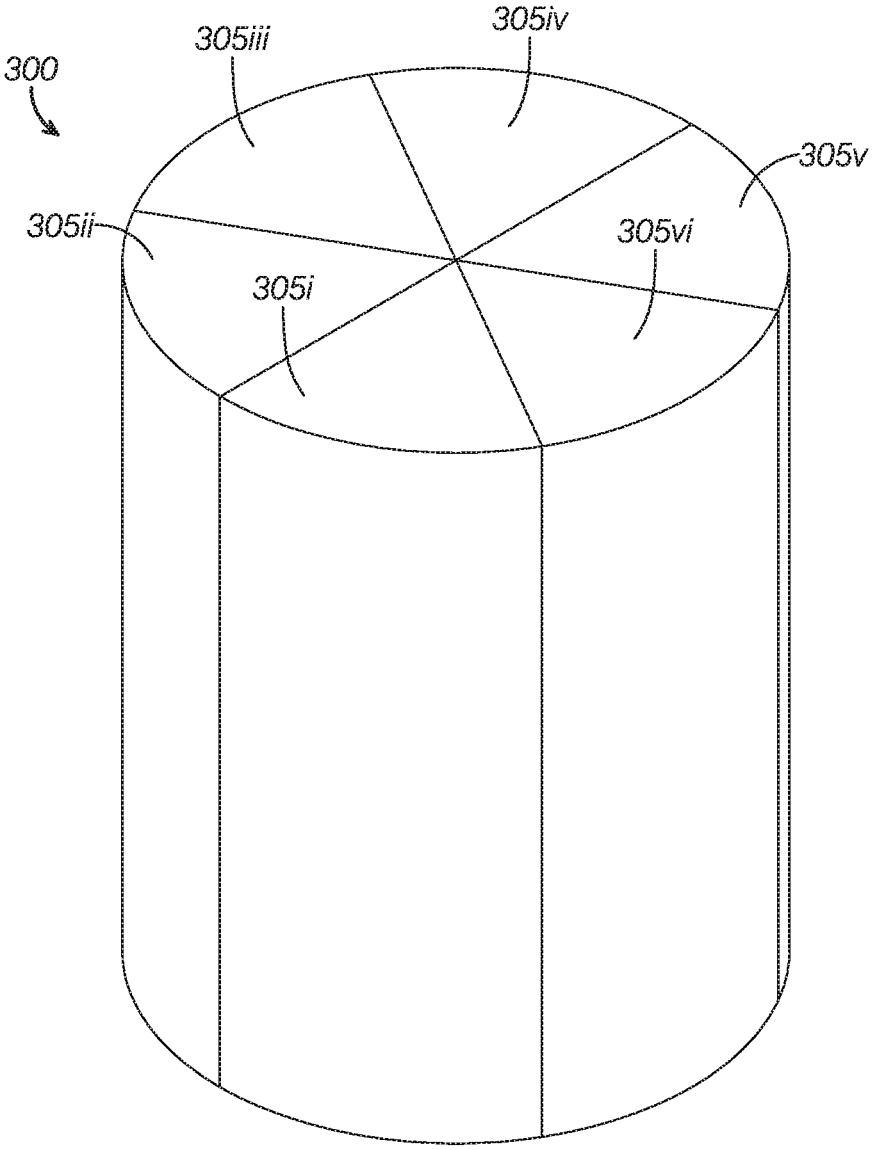
FIG. 11 is a perspective view of a third example of a dispenser system, the dispenser system including six containers.

Turning attention to FIG. 11, a third example of a dispenser system, dispenser system 300, will now be described. Dispenser system 300 includes containers 305*i-vi*. A distinction between dispenser system 300 and dispenser system 100 is that dispenser system 300 does not include a housing. The main difference between dispenser system 300 and dispenser system 200 is that dispenser system 300 includes six containers instead of five. Each container 305 in dispenser system 300 is approximately the same size.

Fourth Embodiment

Figure 14:
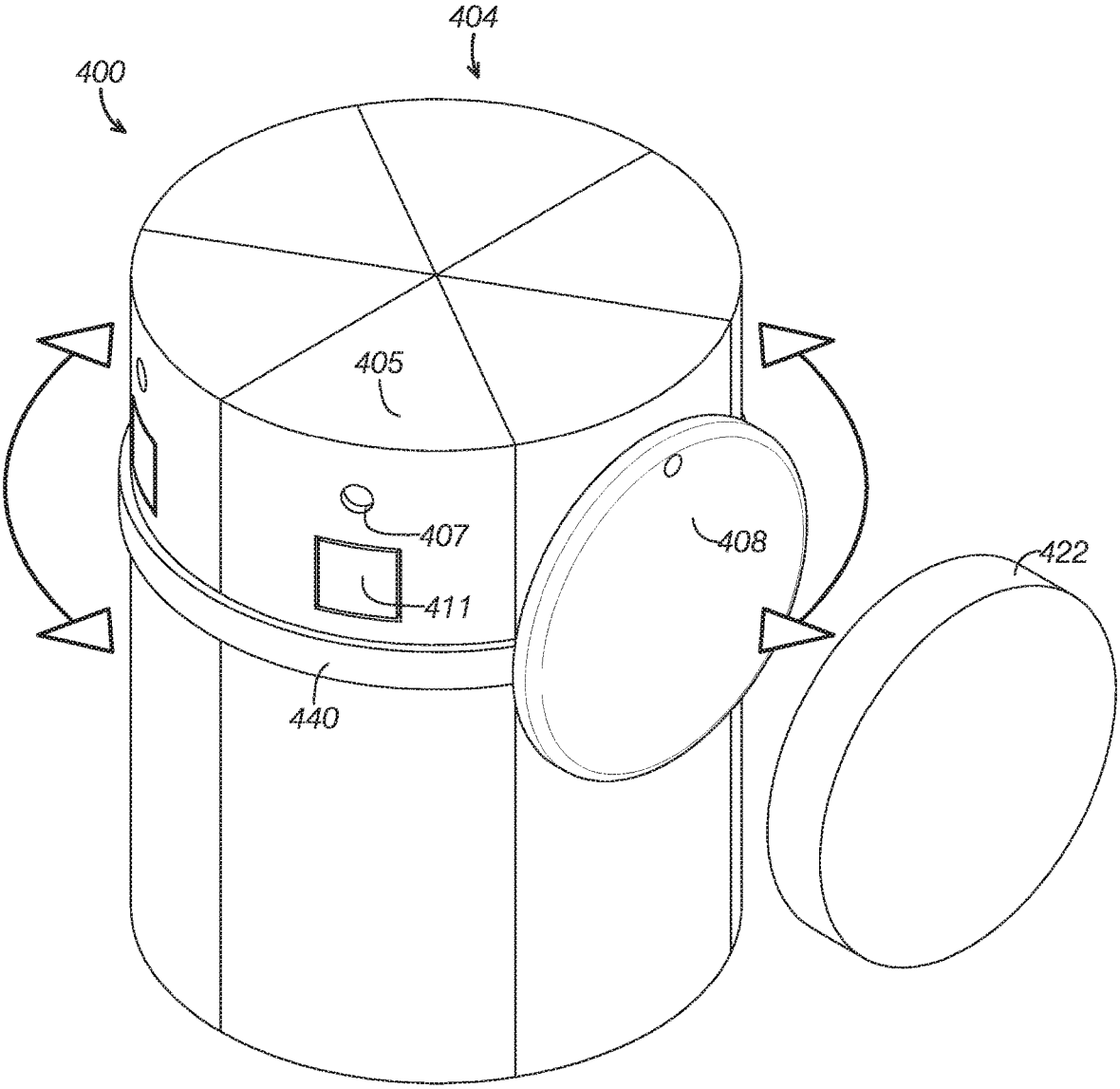
FIG. 14 is a perspective view of a fourth example of a dispenser system, the dispenser system including a support ring and an applicator configured to cooperate with a container defining a side outlet.

With reference to FIG. 14, a fourth example of a dispenser system, dispenser system 400, will now be described. Dispenser system 400 includes six containers 405, an applicator 408, a support ring 440, and a cap 422.

A distinction between dispenser system 400 and dispenser system 100 is that dispenser system 400 includes support ring 440 encircling containers 405 and on which applicator 408 is removably supported. The reader can see in FIG. 14 that support ring 440 supports applicator 408 in a desired position relative to outlets 407 of containers 405. In the FIG. 14 example, support ring 440 is complimentarily configured with the dimensions of container set 404. In some examples, the support ring is adjustable to accommodate container sets of varying dimensions.

In the present example, support ring 440 fits tight enough to the outer circumference of container set 404 to be held in place on container set 404 by friction. However, the fit of support ring 440 is selected to be loose enough to allow support ring 440 to selectively slide relative to container set 404 when moved by a user. In some examples, the support ring is held in place by magnetic attraction. In certain examples, the containers have supports defining a shelf or track formed in them or attached to them by mechanical, adhesive, or magnetic means to movably support the support ring.

Applicator 408 and support ring 440 cooperate to position applicator 408 in a position to collect skincare product from side outlets 407 of containers 405 in container set 404. In particular, as shown in FIG. 14, applicator 408 is supported by support ring 440 in a position to align with an outlet of a desired container when support ring 440 is rotated to align applicator 408 with the outlet of a desired container and to thereby collect skincare product from the desired container when the actuator of the desired container is activated. The applicator may be any conventionally know or later developed type of skincare product applicator, such as brushes, swabs, pads, and the like.

Applicator 408 is removably supported by support ring 440 to enable the user to bring the applicator towards his or her skin to apply skincare product after dispensing skincare product from a desired container onto applicator 408. The applicator may be held in place in the support ring via a friction fit or latch to help secure the applicator to the support ring until the user desires to remove the applicator.

Cap 422 shown in FIG. 14 is complementarily configured with applicator 408 to fit over the top of applicator 408 when desired, such as for storage or when not in use.

Fifth Embodiment

Figure 15:
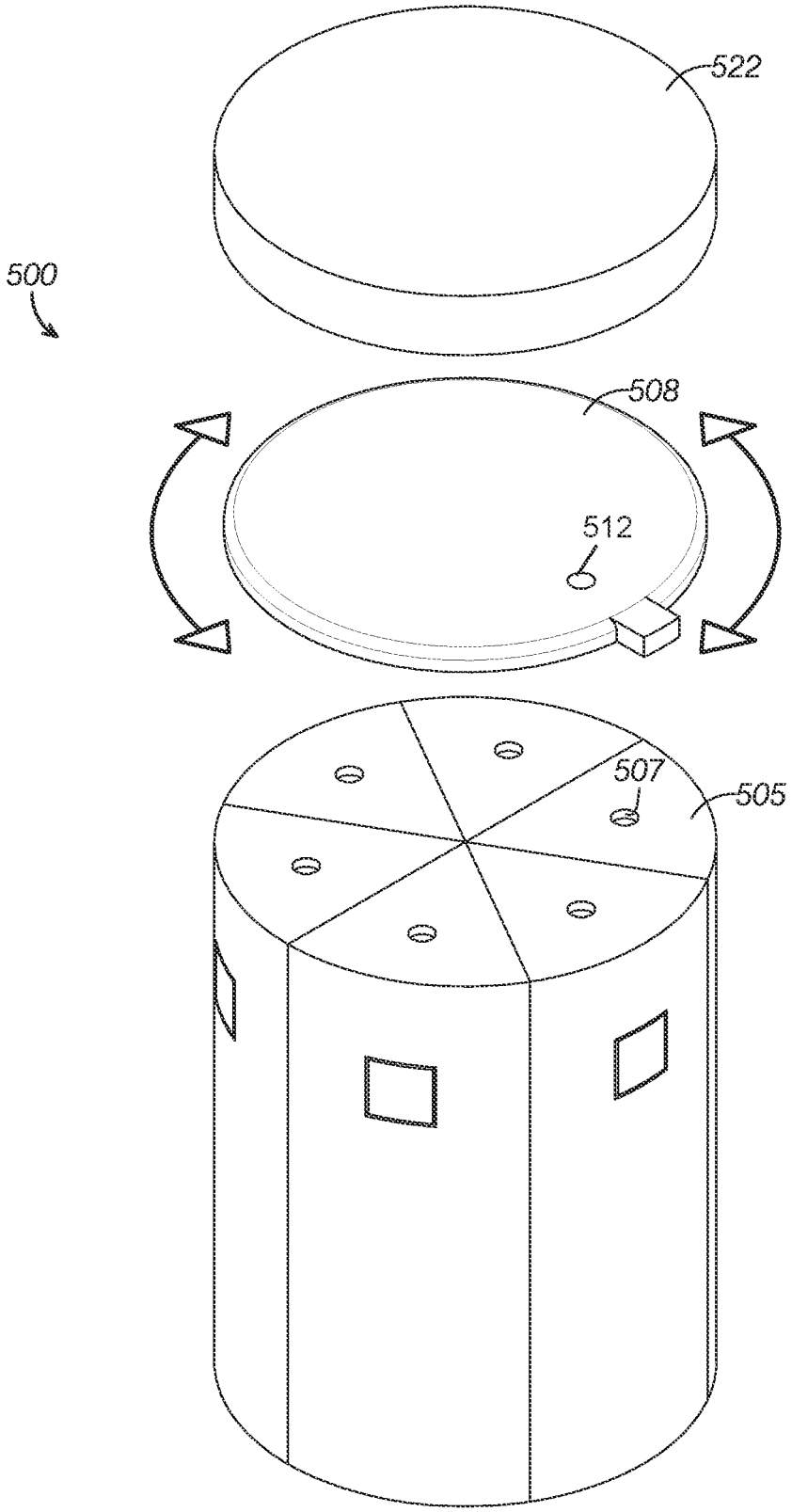
FIG. 15 is a perspective view of a fifth example of a dispenser system, the dispenser system including a valve and an applicator configured to cooperate with a container defining a top outlet.

With reference to FIG. 15, a fifth example of a dispenser system, dispenser system 500, will now be described. Dispenser system 500 includes six containers 505, an applicator 508, and a cap 522.

A distinction between dispenser system 500 and dispenser system 400 is that applicator 508 is removably and rotationally mounted to the top of containers 505 rather than to the side of container set 404 on support ring 440. Applicator 508 shown in FIG. 15 is configured to cooperate with top outlets 507 of containers 505. In particular, applicator 508 includes a port 512 complimentarily configured in size and position with top outlets 507. Port 512 is defined in applicator 508 in a position to align with a selected outlet when applicator 508 is rotated to a position where port 512 overlies the selected outlet. The user can, thus, select a desired container from which to dispense skincare product by rotating applicator 508 to a position where port 512 overlies the outlet of the desired container.

INDUSTRIAL APPLICABILITY

The inventions described in this application may be made by a variety of industrial processes, including by various mechanical assembly and molding techniques.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A dispenser system, comprising:

a plurality of containers supported together to define a container set, each container in the plurality of containers including a dispenser configured to dispense contents within the container; and an applicator operatively coupled to the container set and configured to apply contents from the containers to a target surface wherein:

the applicator includes a body and an application surface and defines a port extending through the body proximate the application surface;

the applicator and the container set are complementarily configured to selectively align the port over the dispenser of a selected container in the container set; and each container in the container set is configured to selectively extend the dispenser through the port when the port is aligned over the dispenser to dispense contents onto the application surface.

2. The dispenser system of claim 1, wherein:

the dispenser is configured to dispense contents in the form of skincare products; and the target surface is a person's skin.

3. The dispenser system of claim 1, wherein the applicator is movable relative to the container set.

4. The dispenser system of claim 1, further comprising a housing in which the container set is disposed.

5. The dispenser system of claim 4, wherein the applicator is movably coupled to the housing.

6. The dispenser system of claim 5, wherein the applicator rotates relative to the housing.

7. The dispenser system of claim 6, wherein:

the housing defines an outer lip;

the applicator is moveably coupled to the outer lip.

8. The dispenser system of claim 7, wherein the applicator translates along the outer lip to rotate relative to the housing.

9. The dispenser system of claim 4, wherein the housing defines a plurality of chambers complementarily configured with the plurality of containers to receive and support the plurality of containers in the plurality of chambers.

10. The dispenser system of claim 9, wherein the plurality of chambers are radially adjacent within the housing.

11. The dispenser system of claim 1, wherein the containers are specifically designed for use in the dispenser system.

12. The dispenser system of claim 1, further comprising a cap selectively covering the applicator.

13. The dispenser system of claim 1, further comprising a cleaning system operatively connected to the container set.

14. The dispenser system of claim 1, wherein:

the port defines a port sidewall;

the dispenser defines a dispenser sidewall; and the dispenser sidewall is disposed between the contents in the dispenser and the port sidewall when the dispenser selectively extends through the port to prevent the contents from contacting the port sidewall.

15. The dispenser system of claim 1, wherein the port extends through the body along a straight port axis.

16. The dispenser system of claim 15, wherein the dispenser extends along a dispenser axis that is coaxial with the port axis when the port is aligned over the dispenser.

17. The dispenser system of claim 1, wherein:

the application surface is flat; and the applicator is configured to apply contents from the containers to the target surface when the applicator is moved proximate the target surface to bring the contents on the application surface in contact the target surface.

18. The dispenser system of claim 17, wherein the application surface has a surface area selected to accommodate the contents on the application surface spreading out over the surface area when the contents are compressed between the target surface and the application surface.

19. The dispenser system of claim 1, wherein:

the dispenser defines an outlet through which the contents are dispensed from within the container;

the body of the applicator includes a backside proximate the container set and opposite the application surface;

the outlet is disposed proximate the backside prior to the dispenser selectively extending through the port; and the outlet is disposed beyond the application surface when the dispenser selectively extends through the port and dispenses contents.

* * * * *